US011082778B2

(12) United States Patent
Wiederholtz

(10) Patent No.: US 11,082,778 B2
(45) Date of Patent: Aug. 3, 2021

(54) DRIVER WITH ACOUSTIC FILTER CHAMBER

(71) Applicant: Knowles Electronics, LLC, Itasca, IL (US)

(72) Inventor: Erik Wiederholtz, St. Charles, IL (US)

(73) Assignee: Knowles Electronics, LLC, Itasca, IL (US)

( * ) Notice: Subject to any disclaimer, the term of this patent is extended or adjusted under 35 U.S.C. 154(b) by 39 days.

(21) Appl. No.: 15/074,801

(22) Filed: Mar. 18, 2016

(65) Prior Publication Data

US 2017/0272868 A1 Sep. 21, 2017

(51) Int. Cl.
*H04R 1/28* (2006.01)
*H04R 25/00* (2006.01)
*H04R 1/10* (2006.01)

(52) U.S. Cl.
CPC ..... *H04R 25/48* (2013.01); *H04R 1/2811* (2013.01); *H04R 1/1016* (2013.01)

(58) Field of Classification Search
CPC ..... H04R 2225/023; H04R 2225/025; H04R 1/28; H04R 1/2815; H04R 1/2826; H04R 1/2869; H04R 1/2873; H04R 1/2876
USPC ..... 381/328, 337, 348–349, 353–354
See application file for complete search history.

(56) References Cited

U.S. PATENT DOCUMENTS 4,450,930 A 5/1984 Killion
5,261,006 A * 11/1993 Nieuwendijk ..... H04R 1/227 381/353
5,319,717 A 6/1994 Holesha
D360,691 S 7/1995 Mostardo
D360,948 S 8/1995 Mostardo
D360,949 S 8/1995 Mostardo
D414,493 S 9/1999 Jiann-Yeong
5,960,093 A 9/1999 Miller
6,002,781 A * 12/1999 Takayama ..... H04R 1/2857 381/351
6,751,326 B2 6/2004 Nepomuceno
6,801,632 B2 10/2004 Olson
7,123,736 B2 * 10/2006 Eaton ..... H04M 1/035 381/345
7,136,500 B2 11/2006 Collins
7,305,098 B2 12/2007 Vonlanthen et al.
D573,588 S 7/2008 Warren
7,477,756 B2 1/2009 Wickstrom
(Continued)

FOREIGN PATENT DOCUMENTS

CN 204119490 1/2015
CN 204145685 2/2015
(Continued)

OTHER PUBLICATIONS

International Search Report and Written Opinion; International Application No. PCT/US2014/039725; dated Sep. 24, 2014 (10 pages).

*Primary Examiner* — Suhan Ni
(74) *Attorney, Agent, or Firm* — Faegre Drinker Biddle & Reath LLP

(57) ABSTRACT

In one aspect, a low frequency driver is provided having a diaphragm operable to produce sound, a front volume, and an outlet that receives sound from the front volume and directs sound out from the low frequency driver. The low frequency driver further includes a low-pass filter chamber in communication with the front volume.

19 Claims, 4 Drawing Sheets

(56) References Cited

U.S. PATENT DOCUMENTS

| | | | | |
|---|---|---|---|---|
| 7,680,292 | B2 | 3/2010 | Warren | |
| 7,747,032 | B2 | 6/2010 | Zei | |
| 7,869,610 | B2 | 1/2011 | Jayanth | |
| 8,135,163 | B2 | 3/2012 | Blanchard et al. | |
| 8,401,215 | B2 | 3/2013 | Warren | |
| 8,594,351 | B2 | 11/2013 | Harlow et al. | |
| 9,087,506 | B1 * | 7/2015 | Kraft | G10L 21/0232 |
| 2003/0190053 | A1 | 10/2003 | Van Halteren | |
| 2006/0045284 | A1 * | 3/2006 | Haussmann | A61F 11/08 381/72 |
| 2006/0133636 | A1 | 6/2006 | Harvey et al. | |
| 2006/0159298 | A1 | 7/2006 | Dombrowski et al. | |
| 2006/0227990 | A1 | 10/2006 | Kirchhoefer | |
| 2007/0104340 | A1 | 5/2007 | Miller | |
| 2007/0223735 | A1 | 9/2007 | Lopresti et al. | |
| 2008/0063223 | A1 | 3/2008 | van Halteren et al. | |
| 2008/0101640 | A1 | 5/2008 | Ballad | |
| 2008/0181443 | A1 * | 7/2008 | Harvey | H04R 1/22 381/380 |
| 2009/0214068 | A1 | 8/2009 | Wickstrom | |
| 2009/0245561 | A1 | 10/2009 | Litovsky et al. | |
| 2010/0310106 | A1 | 12/2010 | Blanchard | |
| 2013/0051580 | A1 | 2/2013 | Miller | |
| 2013/0272564 | A1 | 10/2013 | Miller | |
| 2014/0341394 | A1 * | 11/2014 | Croft, III | H04R 1/2811 381/102 |
| 2014/0355787 | A1 | 12/2014 | Jiles et al. | |
| 2015/0206524 | A1 * | 7/2015 | Kraft | G10L 21/0232 381/71.6 |

FOREIGN PATENT DOCUMENTS

| | | | |
|---|---|---|---|
| CN | 204168483 | | 2/2015 |
| WO | 2006114767 | A1 | 11/2006 |
| WO | 2014193919 | A1 | 12/2014 |

* cited by examiner

DRIVER WITH ACOUSTIC FILTER CHAMBER

TECHNICAL FIELD

This disclosure relates to acoustic devices and, more specifically, to acoustic devices including drivers having filters for controlling the performance of the drivers.

BACKGROUND

Various types of acoustic devices have been used through the years. These devices may include a receiver or driver having a diaphragm, coil, bobbin, stack, and other components within a housing. Some acoustic devices include multiple drivers that produce different frequency sounds for a listener. Examples of such acoustic devices include hearing aids, earphones, smartphones, laptop computers, and personal entertainment devices.

Some prior acoustic devices have an ear bud or similar structure that houses a low-frequency (LF) driver and a high-frequency (HF) driver, wherein the LF driver produces low frequency sound and the HF driver produces high frequency sound. However, the LF driver and the HF driver may produce sounds that have resonant peaks at the same frequency (approximately 5-7 kHz) and these peaks tend to add together. The summation of sounds can yield unpredictable and degraded sound quality.

To address this unwanted sound distortion, in one prior approach an acoustic resistance (e.g., a screen) is used as a low-pass filter for a LF driver and a capacitor, connected in series with a HF driver, acts as a high-pass filter for the HF driver. These filters may attenuate resonance of the LF driver, remove undesired bass response from the HF driver, and produce better quality sound.

In this prior approach, the LF driver and the HF driver are conjoined in such a manner as to form a common front volume and have a common outlet tube. Sounds produced by the LF driver and the HF driver interact within the acoustic device, travel through the outlet tube, exit the acoustic device, and enter a user's ear canal.

One issue with this prior approach is that the shared front volume of the LF driver and the HF driver involves a complex geometry. Tuning the performance of the LF driver for a particular acoustic device may require substantial redesign of the conjoined LF and HF drivers. Another issue is that changes to the front volume of the LF driver may affect the performance of the HF driver and further complicates engineering and manufacture.

BRIEF DESCRIPTION OF THE DRAWINGS

For a more complete understanding of the disclosure, reference should be made to the following detailed description and accompanying drawings wherein.

Persons having ordinary skill in the art will appreciate that elements in the figures are illustrated for simplicity and clarity. It will further be appreciated that certain actions and/or steps may be described or depicted in a particular order of occurrence although such specificity with respect to sequence is not actually required. It will also be understood that the terms and expressions used herein have the ordinary meaning in the art except where specific meanings have otherwise been set forth herein.

DETAILED DESCRIPTION

In accordance with one aspect of the present disclosure, a low frequency driver is provided having a diaphragm operable to produce sound, a front volume, and an outlet that receives sound from the front volume and directs sound out from the low frequency driver. The low frequency driver further includes a low-pass filter chamber in communication with the front volume. In this manner, the low-pass filter chamber effectively enlarges the front volume and provides improved roll-off of the response of the low-frequency driver at higher frequencies. Further, the low-pass filter chamber permits the response of the low frequency driver to be acoustically tuned for a particular application in a cost effective and straightforward manner.

In one form, the low frequency driver has a housing containing the movable diaphragm, the front volume, and the low-pass filter chamber. The housing comprises a body including the front volume and the diaphragm and further comprises a cap connected to the body. The body and cap define at least a portion of the low-pass filter chamber therebetween. The response of the low frequency driver may be tailored for a particular application by selecting a cap having a particular geometry, such as an interior volume, from a plurality of caps having different interior volumes. For example, a cap having a larger interior volume may be selected and secured to a body of a low frequency driver for an application where greater dampening of a second resonant frequency of the low frequency driver is desired. Conversely, a cap having a smaller interior volume may be selected and secured to the body of the low frequency driver for an application where less dampening of the second resonant frequency is required.

Figure 1A:
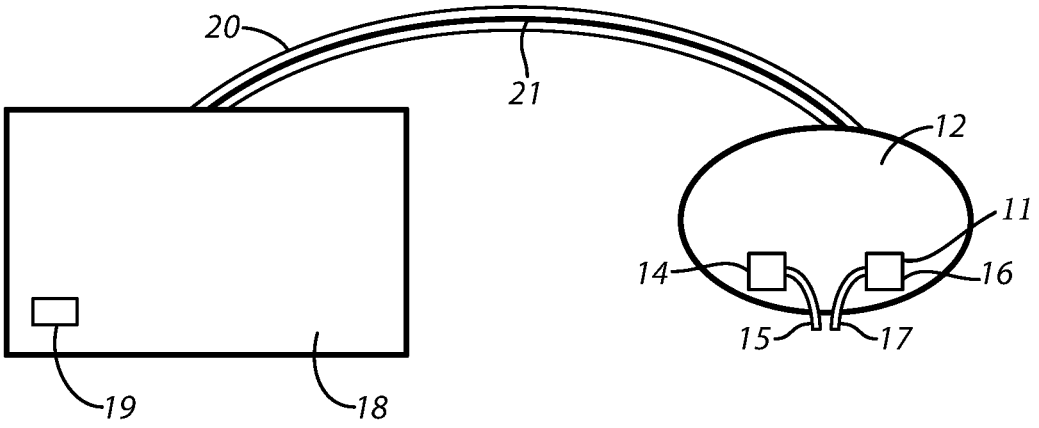
FIG. 1A is a schematic view of a hearing aid.

Referring now to FIG. 1A, an acoustic device, such as a hearing aid 10, is provided. The hearing aid 10 includes a behind-the-ear component 18 and a connector, such as a conduit 20, which includes at least one wire 21. The behind-the-ear component 18 typically houses a battery, a microphone 19, and an amplifier, as well as other circuitry. The behind-the-ear component 18 receives sound from the outside environment via the microphone 19. The conduit 20 extends over the ear and attaches to an in-the-ear component 12 of the hearing aid 10. The in-the-ear component 12 receives the sound signals from the behind-the-ear component 18 via the at least one wire 21.

The in-the-ear component 12 includes one or more drivers, such as a LF driver 14 and a HF driver 16. Typically, LF drivers produce sound in the range of approximately 20 Hz to approximately 8 kHz frequency and HF drivers produce sound in the range of approximately 4 kHz to approximately 20 kHz frequency range, and thus have a typical overlap in response. The in-the-ear component 12 directs the sound toward a user's eardrum through a tube 15 extending from the LF driver 14 and a tube 17 extending from the HF driver 16. The HF driver includes a housing 11.

Figure 2:
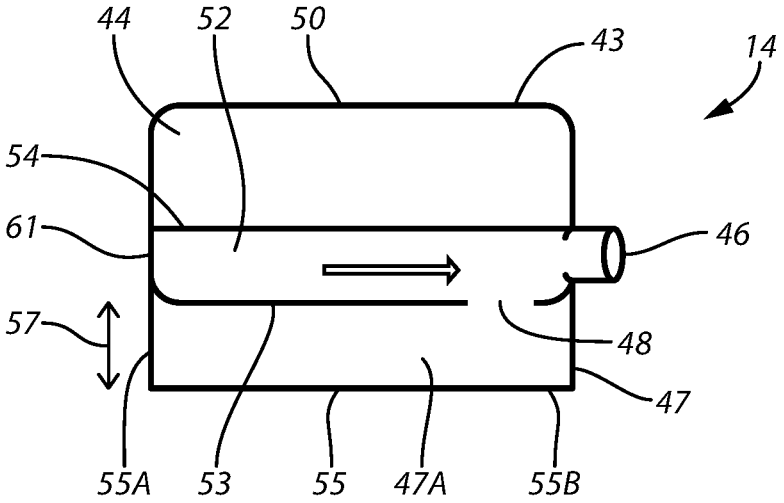
FIG. 2 is a cross-sectional, schematic view of a low frequency driver of the hearing aid of FIG. 1A showing a low-pass filter chamber of the driver.

With reference to FIG. 2, the LF driver 14 has a housing 50, a front volume 52, a back volume 44, and a low-pass filter chamber 47. As used herein, the "front volume" of a driver refers to a cavity of the driver that is separated from a back volume of the driver by the diaphragm of the driver. The geometry of the low-pass filter chamber 47 can be selected for a particular application to tune the performance of the LF driver 14, such as by having a larger or smaller an internal volume 47A of the low-pass filter chamber 47. Unlike some prior approaches, the front volume 52 of the LF driver 14 is not shared with the HF driver 16. Because the front volume 52 is not shared with the HF driver 16, the geometry of the low-pass filter chamber 47 may be changed during the design process to produce a desired performance of the LF driver 14 without affecting the response of the HF driver 16. By contrast, changing the geometry of a LF driver conjoined to HF driver, wherein the LF driver and HF driver share a front volume, may affect the performance of the HF driver and the performance of the conjoined LF driver and HF driver. Because the LF driver 14 can be tuned without affecting the response of the HF driver 16, the LF driver 14 reduces engineering and manufacturing resources involved in providing an acoustic apparatus for a particular application.

With continued reference to FIG. 2, the front volume 52 and the back volume 44 are separated by a movable diaphragm 54 supported within the housing 50. In one form, the diaphragm 54 is the only diaphragm within the housing 50. The LF driver 14 has an outlet, such as a portion 46 of the tube 15, where sound can exit the LF driver 14. The portion 46 could be positioned to connect to either front volume 52 or 47A as a way to form the low-pass filter.

The low-pass filter chamber 47 may be formed integrally as a part of the housing 50. In another form, the housing 50 includes a body 61 and a cover member, such as cap 55, connected to the housing 50. The body 61 and cap 55 together define at least a portion of the low-pass filter chamber 47. The body 61 has a wall 53 separating the front volume 52 and the low-pass filter chamber 47. The cap 55 has one or more sidewalls 55A depending from the body 61 and a cover wall 55B extending transversely to the sidewalls 55A. In one form, the body 61 and cap 55 together define the entirety of low-pass filter chamber 47.

The LF driver 14 includes a port 48 permitting the passage of air between the front volume 52 and the low-pass filter chamber 47. The port 48 may have a number of forms, such as a tube or one or more openings. In FIG. 2, the port 48 is shown as circular through-opening in the wall 53. The shape and location of the port 48 can be tuned to change the response of the LF driver 14 as desired.

In one form, the LF driver 14 is not acoustically linked to the HF driver 16. As used herein, the term "not acoustically linked" is intended to refer to the response of the LF driver 14 not being controlled by or significantly impacted by the response of the HF driver 16.

Figure 1B:
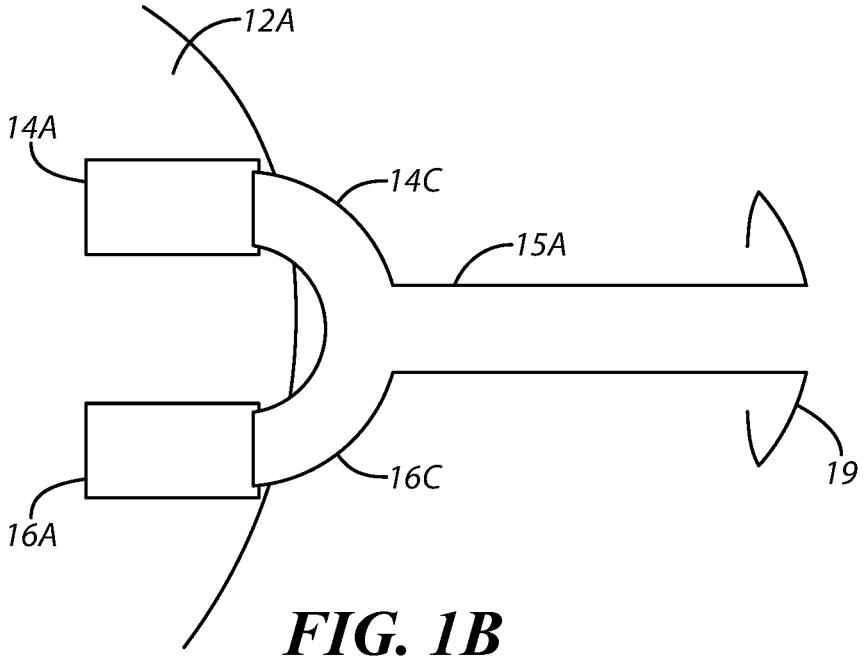
FIG. 1B is a schematic view of a portion of another hearing aid.

With reference to FIG. 1B, an in-the-ear component 12A is provided having an LF driver 14A and an HF driver 16A that do not interact through any direct connected path of the in-the-ear-component 12A until after the sound from the LF driver 14A and HF driver 16A exit respective tubes 14C, 16C. The tubes 14C, 16*c* meet at a common exit tube 15A. The exit tube 15A extends through an eartip 19 and sound exits into the ear canal.

Figure 3:
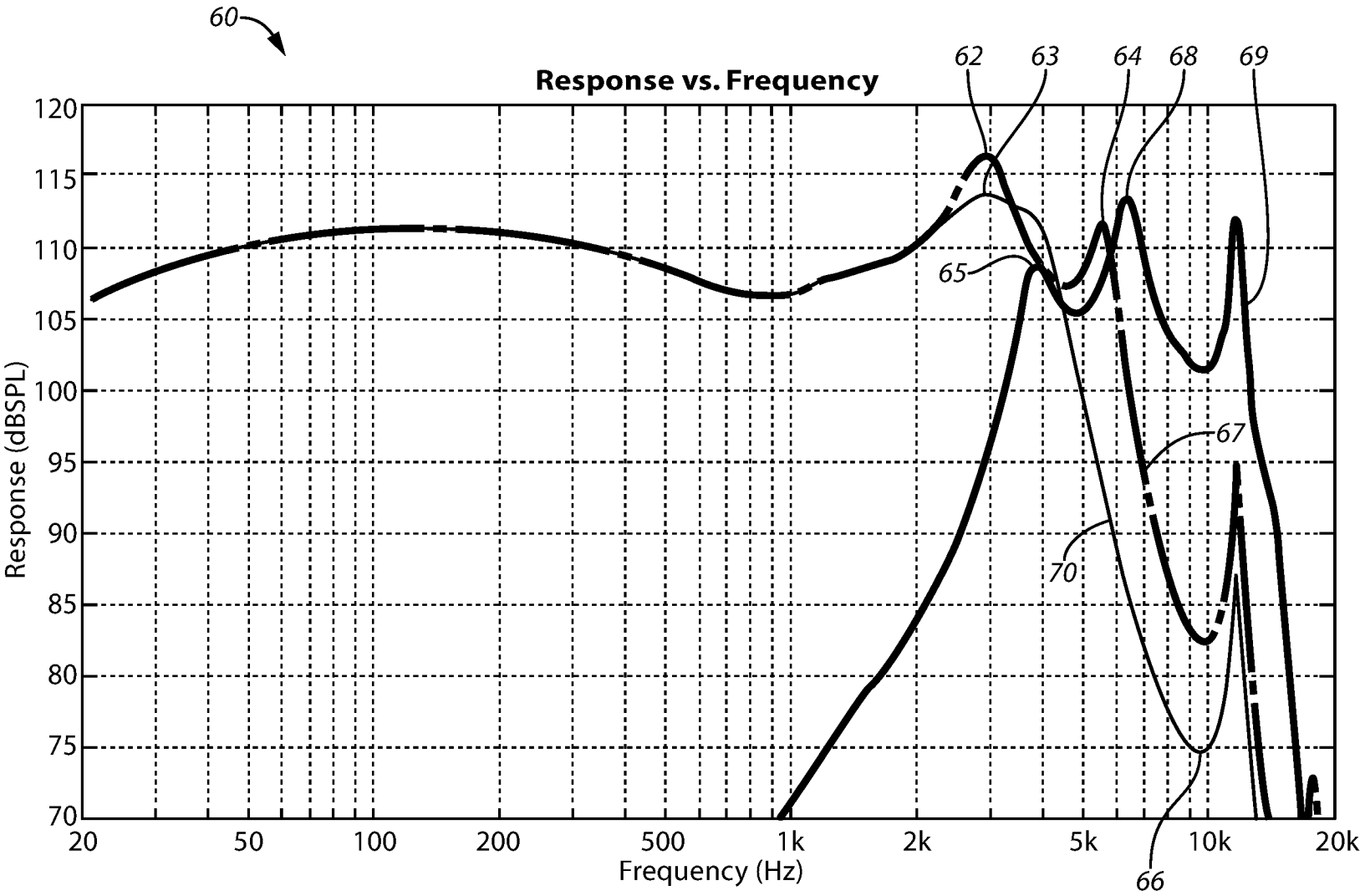
FIG. 3 is a graph of the response of the low frequency driver of FIG. 2, a low frequency driver without an acoustic low-pass filter chamber, and a high frequency driver.

In FIG. 3, a graph 60 of driver response as a function of frequency is provided. In graph 60, a curve 69 is shown for the HF driver 16, a curve 67 is shown for a LF driver without the low-pass filter chamber 47, and a curve 70 is shown for the LF driver 42 with the low-pass filter chamber 47. A Knowles® RAB-31761-000 receiver was used to obtain curves 67 and 70.

The response of the HF driver 16 represented by curve 69 is in the range of approximately 4 kHz to approximately 20 kHz, and the response of the LF drivers represented by the curves 67, 70 are in the range of approximately 20 Hz to approximately 8 kHz. The HF driver 16, the LF driver without the low-pass filter chamber 47, and the LF driver 14 with the low-pass filter chamber 47 generate main mechanical resonance peaks 62, 63, 65 along the curves 69, 67, 70. The HF driver 16 and the LF driver without the low-pass filter chamber 47 also exhibit second acoustic peaks 64, 68 along the curves 69, 67. As shown in FIG. 3, the second acoustic peak 64 of the LF driver without the low-pass filter chamber 47 overlaps with the second acoustic peak 68 of the HF driver 16 at approximately 5-7 kHz and degrades sound quality.

With reference to FIGS. 2 and 3, the low-pass filter chamber 47 effectively enlarges the front volume 52. This additional volume operates as a low-pass filter by causing a roll-off in the curve 70 and dampening the second resonant peak produced by the LF driver 14. The curve 70 has a mechanical resonance peak 63 at approximately 3 kHz, then precipitously rolls off to a trough 66 at approximately 9-10 kHz. Whereas the curve 67 has the second resonant peak 64, the curve 70 has a trough 66. The low-pass filter chamber 47 thereby reduces the response of the LF driver 14 in the 5-7 kHz frequency range which reduces overlap between the LF driver 14 and the HF driver 16 and thereby improves sound quality.

The geometry of the low-pass filter chamber 47 may be selected to provide a desired response of the LF driver 14. For example, the low-pass filter chamber 47 has a height 57 (see FIG. 2) that may be selected for a particular combination of diaphragm 54 and front volume 52 to provide a desired dampening of the response of the LF driver 14. As another example, for a given LF driver 14, an engineer may have several caps 55 available with different internal volumes 47A. To cause roll-off of a given LF driver 14 at a chosen frequency, and thus less overlap with the response of the HF driver 16, the engineer may select the cap 55 having a larger internal volume 47A for the LF driver 14.

The low-pass filter chamber 47 may be formed in a number of ways. For example, the body 61 may initially be provided with the body 61 including the back volume 44, diaphragm 54, front volume 58, and tube portion 46. Next, an opening is formed in the wall 53 to form the port 48, such as by stamping. The cap 55 is positioned over the wall 53 so that the cap 55 covers the port 48. The cap 55 may then be secured to the body 61 such as by welding, using an adhesive, using one or more fasteners, or other approaches.

The cap 55 may be made of plastic, metallic, or other materials. Likewise, the body 61 may be made of plastic, metallic (such as stainless steel, mu-metal, and aluminum), or other materials and be similar to or different from the materials of the cap 55. The diaphragm 54 may be made of a metallic material, such as stainless steel or aluminum.

Figure 4:
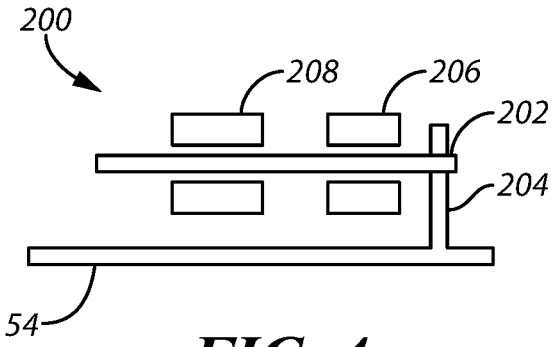
FIG. 4 is a schematic view of a balanced armature motor of the low frequency driver of FIG. 2.

With reference to FIG. 4, the back volume 44 may include a motor, such as a balanced armature 200, for moving the diaphragm 54. The balanced armature 200 includes an armature 202 connected to the diaphragm 54 via a drive pin 204. The balanced armature 200 further includes a magnet assembly 206 and a coil assembly 208. The armature 200 moves in response to electrical audio signals received from the circuitry of the in-the-ear or behind the ear component 12, 18. The corresponding movement of the armature 202 is translated into acoustic energy or sound waves by the diaphragm 54.

Preferred embodiments are described herein, including the best mode known to the inventor(s) for carrying out the disclosure. It should be understood that the illustrated embodiments are exemplary only, and should not be taken as limiting the scope of the disclosure.

What is claimed is:

1. An acoustic receiver comprising:

a housing;

a diaphragm movably disposed within the housing, the diaphragm separating an interior of the housing into a front volume and a back volume, a cap that is a separate element from the housing, the cap secured to the housing forming an assembly;

a low-pass filter chamber having a fixed volume formed in part by the secured cap and in part by a portion of the housing, the low-pass filter chamber coupled to the front volume; and a sound outlet port disposed between the front volume or the low-pass filter chamber and an exterior of the housing, wherein movement of the diaphragm causes sound to emanate from the front volume and through the sound outlet port, wherein the fixed volume of the low-pass filter chamber affects a frequency response of the acoustic device.

2. The acoustic receiver of claim 1, wherein the front volume is coupled to the low-pass filter chamber by a port, other than the sound outlet port, that passes through a wall of the housing.

3. The acoustic receiver of claim 2, wherein the secured cap is connected to a portion of the housing defining the front volume.

4. The acoustic receiver of claim 3, wherein a housing wall of the housing separates the front volume and the low-pass filter chamber, and wherein the port is disposed through the housing wall.

5. The acoustic receiver of claim 4 further comprising a motor disposed in the back volume of the housing, the motor coupled to the diaphragm, wherein the motor moves the diaphragm in response to an electrical excitation signal applied to a coil of the motor.

6. The acoustic receiver of claim 5, wherein the acoustic receiver is a low frequency driver.

7. The acoustic receiver of claim 6, wherein the front volume is not shared with another acoustic receiver.

8. The acoustic receiver of claim 6, wherein the sound outlet port is disposed between the front volume and the exterior of the housing.

9. The acoustic receiver of claim 5 is part of an in-the-ear component.

10. An acoustic device comprising:

a first acoustic receiver comprising a first housing;

a second acoustic receiver comprising a second housing that includes a diaphragm movably disposed within the second housing, the diaphragm separating an interior of the second housing into a front volume and a back volume;

a cap, that is a separate element from the second housing and secured to a portion of the second housing, the secured cap and the portion of the second housing forming a low-pass filter chamber having a fixed volume, the low-pass filter chamber coupled to the front volume by a port, the front volume not acoustically coupled to an interior volume of the first housing; and a sound outlet port disposed between the front volume or the low-pass filter chamber and an exterior of the second housing, wherein movement of the diaphragm causes sound to emanate from the front volume and through the sound outlet port, wherein the fixed volume of the low-pass filter chamber affects a frequency response of the acoustic device.

11. The acoustic device of claim 10, wherein a housing wall of the second housing separates the front volume and the low-pass filter chamber, and wherein the port is disposed through the housing wall.

12. The acoustic device of claim 11 further comprising a motor disposed in the back volume of the second housing, the motor coupled to the diaphragm, wherein the motor moves the diaphragm in response to an electrical excitation signal applied to a coil of the motor.

13. The acoustic device of claim 12, wherein the sound outlet port is disposed between the front volume and the exterior of the housing.

14. The acoustic device of claim 10 wherein the second acoustic receiver is a balanced armature receiver.

15. The acoustic device of claim 14 is part of an in-the-ear component.

16. An acoustic device comprising:

a first acoustic receiver comprising:

a first diaphragm movably disposed within a first housing and separating an interior of the first housing into a first front volume and a first back volume;

a discrete cap a separate from the first housing, the cap secured to the first housing;

a low-pass filter chamber having a fixed volume formed in part by the cap and in part by a portion of the first housing when the cap is secured to the first housing, the low-pass filter chamber coupled to the first front volume;

a first sound outlet port disposed between the first front volume or the low-pass filter chamber and an exterior of the first housing, wherein movement of the first diaphragm causes sound to emanate from the first front volume and through the first sound outlet port, wherein the fixed volume of the low-pass filter chamber affects a frequency response of the acoustic device; and a second acoustic receiver having a second output joined with the first acoustic receiver through a common exit tube.

17. The acoustic device of claim 16, wherein the second front volume is acoustically isolated from the first front volume, and wherein sound emanating from the first sound outlet port is combined with sound emanating from the second sound outlet port.

18. The acoustic device of claim 17, wherein the first acoustic receiver is a low frequency driver and the second acoustic receiver is a high frequency driver.

19. The acoustic device of claim 16, wherein the first acoustic receiver and the second acoustic receiver constitute part of an in-the-ear component.

* * * * *